US006508682B1

(12) United States Patent
Clark

(10) Patent No.: US 6,508,682 B1
(45) Date of Patent: Jan. 21, 2003

(54) WATER TRAMPOLINE

(76) Inventor: David P. Clark, 9114 136th St. Ct. NW., Gig Harbor, WA (US) 98324

( * ) Notice: Subject to any disclaimer, the term of this patent is extended or adjusted under 35 U.S.C. 154(b) by 0 days.

(21) Appl. No.: 09/954,590

(22) Filed: Sep. 14, 2001

(51) Int. Cl.[7] ..... B63B 35/58
(52) U.S. Cl. ..... 441/40; 441/131; 482/27
(58) Field of Search ..... 441/1, 35, 40, 441/129, 131, 136; 182/139; 482/27

(56) References Cited

U.S. PATENT DOCUMENTS 2,991,841 A * 7/1961 Sampson et al. ..... 482/27
3,047,294 A * 7/1962 Maxwell ..... 182/139
3,095,947 A * 7/1963 Beaulauier ..... 182/139
5,810,695 A * 9/1998 Sass ..... 441/37

* cited by examiner

*Primary Examiner*—Stephen Avila
(74) *Attorney, Agent, or Firm*—Jensen & Puntigam, P.S.

(57) ABSTRACT

The water trampoline includes a generally doughnut-shaped inflatable tube having an open center area. A mesh rebound member extends over the open center area and is secured around its entire periphery to the tube on the upper surface of the tube member. The attaching/securing elements include a plurality of side-by-side loop elements which extend toward the open center area of the tube from the upper surface thereof and a plurality of side-by-side loop elements which extend from the periphery of the rebound member. A first cord extends through the loop members, alternately between alternate tube loop members and rebound element loop members. A second cord member extends through the loop members through which the first cord does not extend. The cord members are tightened, moving the loop members together endwise.

9 Claims, 3 Drawing Sheets

WATER TRAMPOLINE

TECHNICAL FIELD

This invention relates generally to inflatable trampoline devices which are used in bodies of water, such as lakes, and more specifically concerns a structure for securing the water trampoline's central resilient (rebounding) mesh portion to the surrounding inflatable tube portion.

BACKGROUND OF THE INVENTION

Water trampoline devices are in general well known. Examples of such water trampolines are shown in U.S. Pat. No. 4,576,375 to Roberts; U.S. Pat. No. 5,810,695 to Sass; and U.S. Pat. No. 4,598,904 to Roth, among others.

Typically, the devices include an inflatable tube in the shape of a ring or doughnut and a central rebounding mesh portion, which is connected around its outer periphery to the inflatable tube, typically near the top of the tube. The mesh portion, which is the rebound member, extends over the central opening of the tube. One of the structural challenges of such a device is the connection between the central rebound member and the inflatable tube. Various securing/attaching elements are known to connect the rebound member and the tube, including rubber strands, such as shown in the '375 patent, or more typically, springs or bungee-type devices, such as shown in the '695 patent and in U.S. Pat. No. 5,385,518 to Turner. However, the carefully covered elements do have disadvantages. They must be carefully covered to avoid contact injury, and they typically add to the complexity and the cost of manufacture of the water trampoline.

Hence, it is desirable that an attaching structure be developed which is safe, reliable and durable, but also is convenient to manufacture and use in the assembly of the water trampoline.

DISCLOSURE OF THE INVENTION

Accordingly, the invention is an inflatable water trampoline, comprising: a generally doughnut-shaped inflatable tube having an open center area; a rebound member configured to extend over the open center area of the inflatable tube, the rebound member providing a trampoline effect for a user when the rebound member is operatively secured to the tube; wherein the tube includes a plurality of side-by-side loop elements extending inwardly toward the center area thereof from an upper surface of the tube around the periphery thereof, and wherein the rebound member includes a plurality of loop elements which extend outwardly from the periphery of the rebound member, wherein the loop elements from the tube and the loop elements from the rebound element are structured to permit a cord member to be weaved therethrough; and a first cord member extending through loop elements on the rebound member and the tube and arranged so as to securely connect the rebound member and the tube.

BEST MODE FOR CARRYING OUT THE INVENTION

Figure 1:
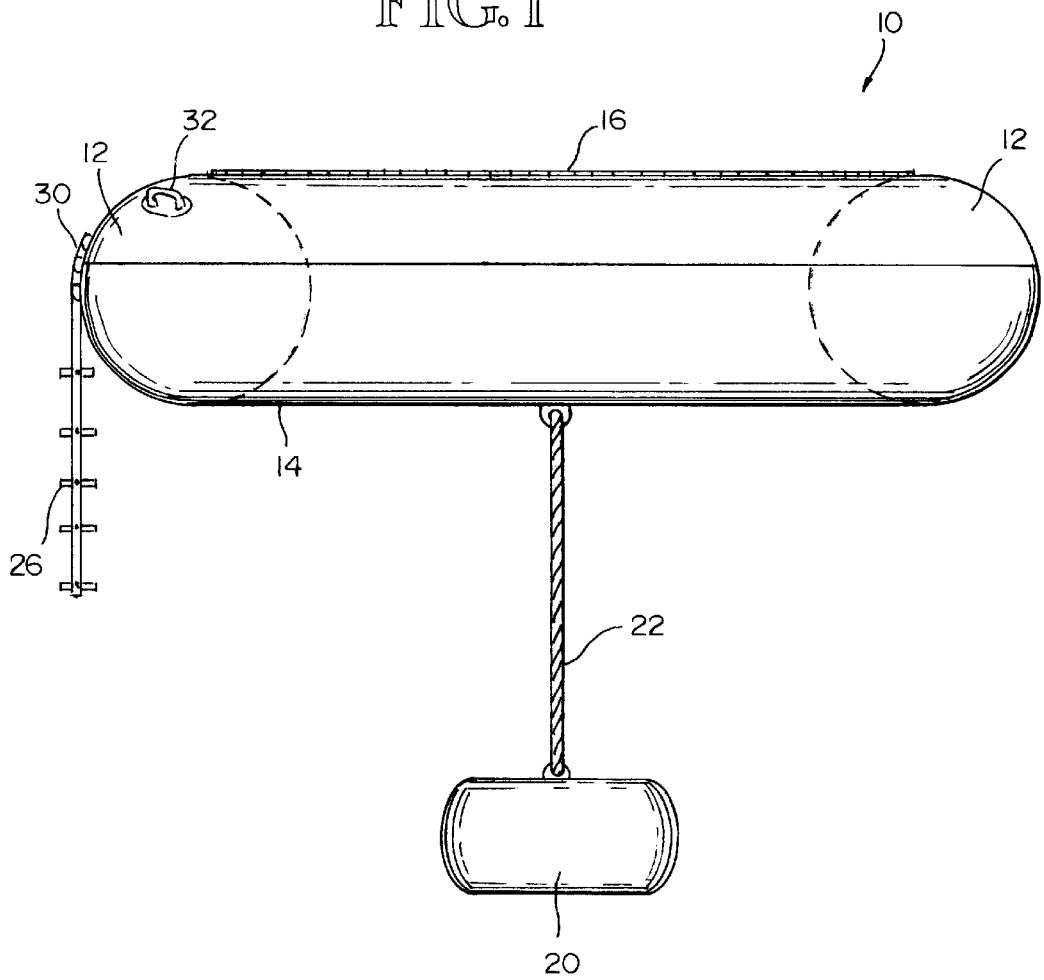
FIG. 1 is an elevational view of the water trampoline of the present invention shown in a body of water.
Figure 2:
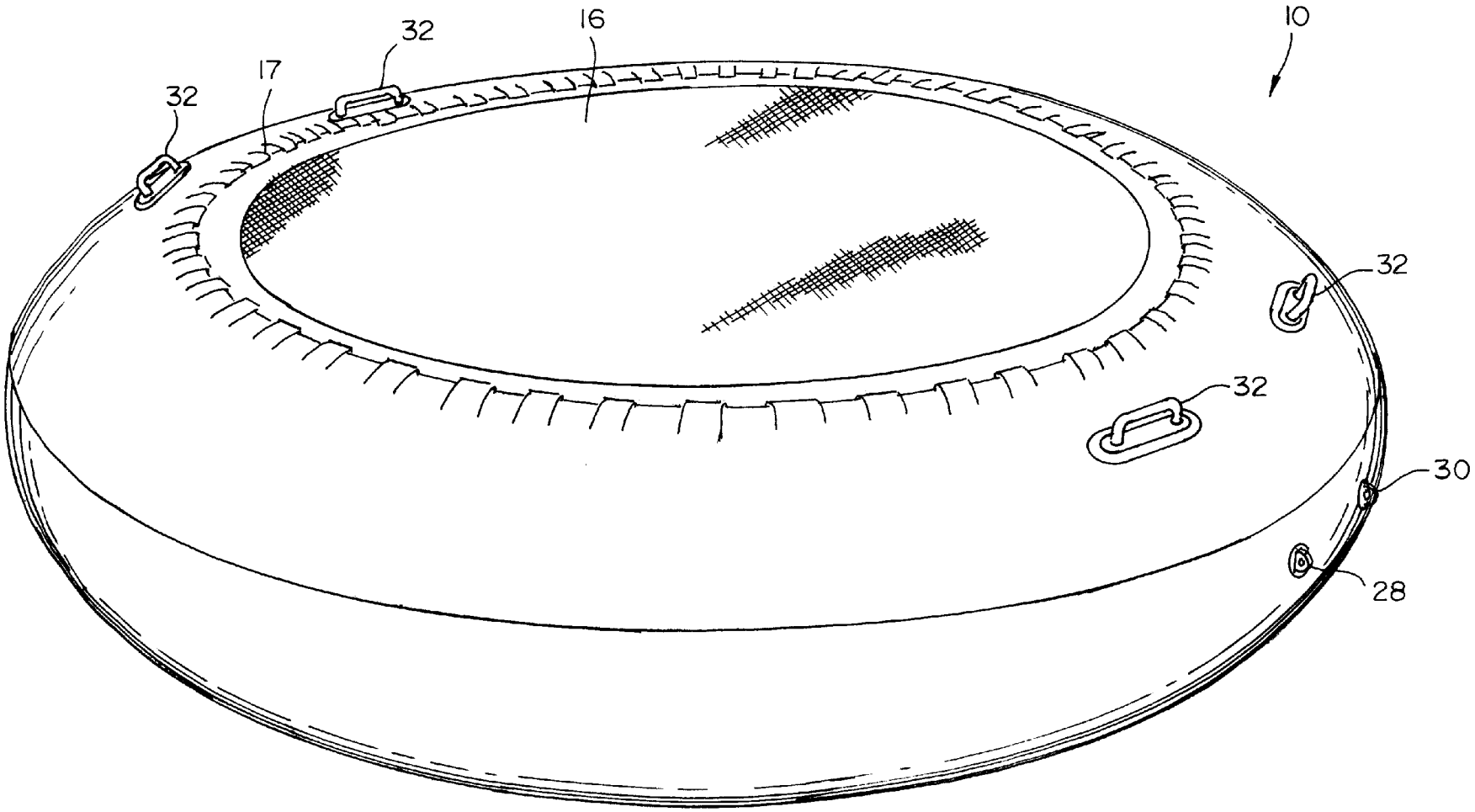
FIG. 2 is a perspective view of the trampoline of FIG. 1.

FIGS. 1 and 2 show the complete water trampoline of the present invention, referred to generally at 10. Water trampoline 10 includes an inflatable tube 12 in the shape of a doughnut. The tube 12 itself can be of various cross-sectional diameters; the diameter of the doughnut configuration can also vary. In one embodiment, the doughnut has an outside diameter of nine feet, while the tube has a cross-sectional diameter of approximately 24 inches. In the embodiment shown, tube 12 is 30 gauge PVC material, which is a heavy-duty plastic and resistant to puncture. Again, however, different materials can be used.

Extending across the central opening defined by the doughnut configuration at the bottom surface portion of the tube and attached thereto is a lower PVC plastic cover element 14 secured to tube 12 by various means, such as by heat sealing or other PVC joining technique. At the upper surface portion of tube 12 is a resilient rebound element 16. In the embodiment shown, rebound element 16 is nylon mesh and PVC, circular in configuration, and covers the central opening of the doughnut tube at the upper surface thereof.

In the embodiment shown, for a nine-foot doughnut tube, rebound element 16 is 60 inches in diameter. Rebound element 16, a mesh arrangement of nylon and PVC, is sufficiently elastic and resilient to provide a trampoline effect when jumped on by a user. The mesh material is well known and therefore not described in more detail. The rebound element 16 is secured along its outer peripheral edge 17 to the inflatable doughnut tube, at the upper or top edge of the tube. The attaching structure between rebound element 16 and tube 12 is described in more detail below.

Water trampoline 10 will typically, but not necessarily, include additional (accessory) elements, including an anchor 20 with an anchor rope 22 attached to the lower cover element 14, typically at the center thereof. In one embodiment, rope 22 is approximately 12 feet long and anchor 20 is a PVC bag with a 20-pound weight therein. These elements can certainly, however, be changed.

Also in the embodiment shown, water trampoline 10 includes at least one ladder 26, which extends downwardly into the water from inflatable tube 12 from attachment points 28 and 30 on the outer periphery of the tube. Ladder 26 can be made, for instance, of lengths of rope with horizontal wood slats or rods extending therebetween. Ladder 26 is used by a swimmer to ascend onto the water trampoline.

Water trampoline 10 also includes grip elements 32—32 on the outer periphery of the tube so as to provide another way for a swimmer to ascend onto the trampoline.

Figure 3:
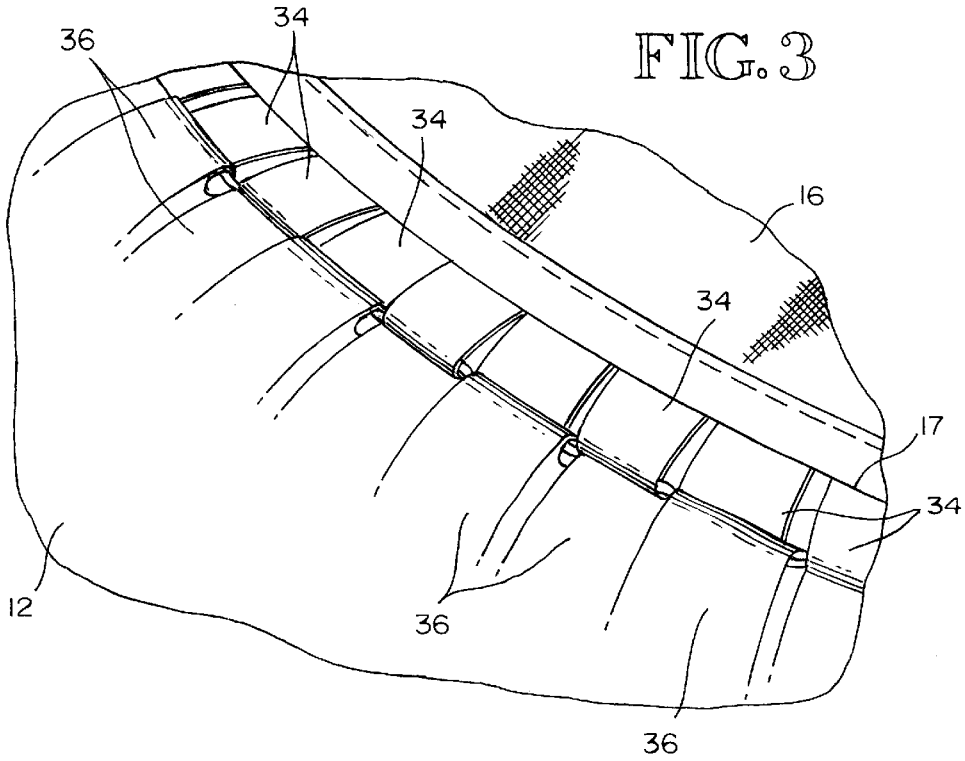
FIGS. 3 and 4 are schematic views of a portion of the device of FIG. 2 showing the attaching structure between the trampoline mesh portion and the surrounding inflatable tube.
Figure 4:
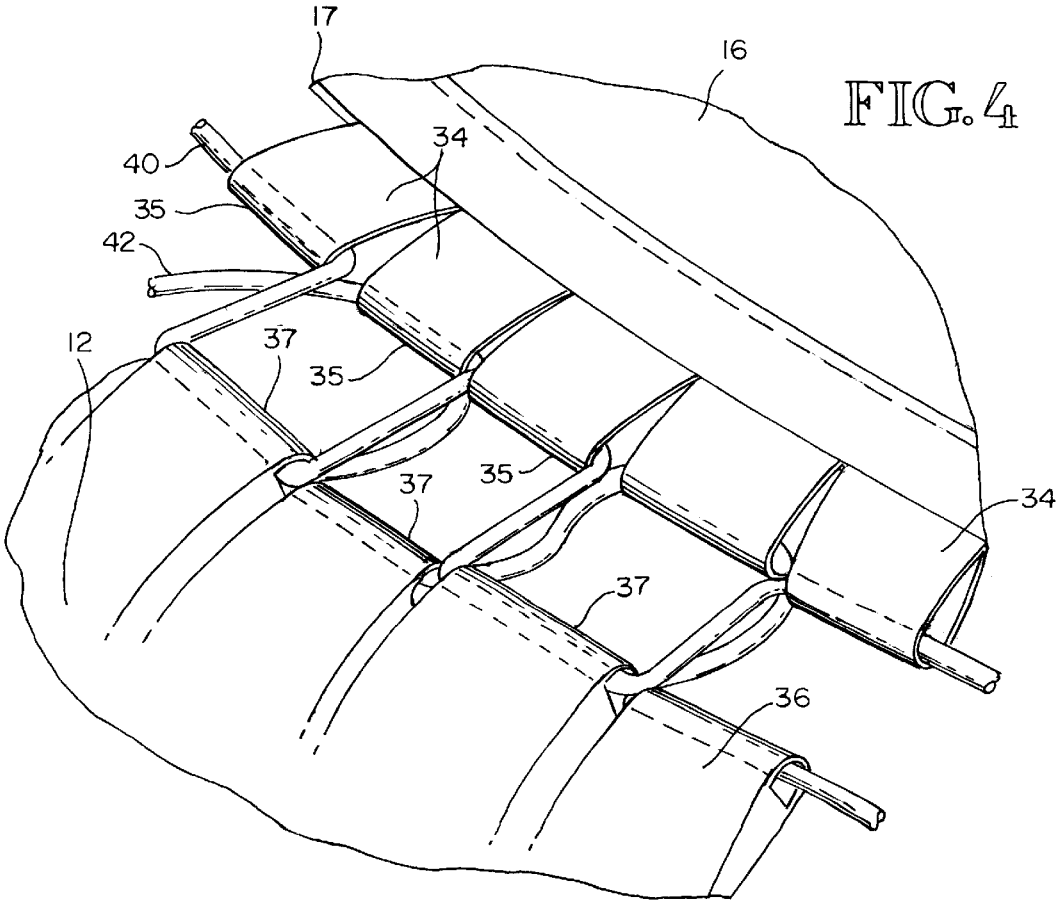

The attaching structure for doughnut tube 12 and rebound element 16 is shown in detail in FIGS. 3 and 4. Extending outwardly from the peripheral edge 17 of the rebound element 16 are a plurality of closely adjacent fabric loops 34—34. Fabric loops 34—34 are made of heavy duty nylon mesh material, and are arranged side by side, with each loop being approximately two inches wide and extending approximately two inches outwardly from the edge 18 of rebound element 16, to which they are securely attached, typically by sewing. The openings defined by loops 34—34 are large enough to permit a small diameter rope or cord to extend therethrough.

Secured by heat sealing or similar PVC joining technique at the top of doughnut tube 12 and extending inwardly toward the central opening of the tube are fabric loops 36—36. Fabric loops 36—36 are approximately the same width and length as loops 34—34 and are made from the same PVC material as the tube 12. The loop ends 35—35 of loops 34 from rebound element 16 come directly adjacent loop ends 37—37 of fabric loops 36—36 from tube 12.

A first length of cord 40, which in the embodiment shown is nylon, approximately ⅛th inch in diameter, is looped alternately through alternate loops 34 and alternate loops 36, i.e. through a first loop 34, then the next adjacent loop 36, then the next adjacent loop 34 (skipping an intermediate loop 34), then the next adjacent loop 36 (skipping an intermediate loop 36), and so forth, as shown in FIG. 4, until the cord 40 extends all the way around trampoline 10.

A second cord 42 is then weaved through the alternate vacant ones of loops 34 and 36. When this has been completed, all of the loops 34—34 and 36—36 are thus used with cords 40 and 42 each going back and forth alternately between loops 34 and 36. When cords 40 and 42 have been weaved through all the loops 34—34 and 36—36, they are tightened so that each loop end 35 of loops 34—34 comes immediately adjacent a loop end 37 of loops 36—36, as shown in FIG. 3.

The structural connection between rebound element 16 and the doughnut tube 12 is thus secure. The two cords 40 and 42 are then secured to maintain the close physical relationship between the two sets of loops 34, 36. The arrangement shown is convenient to assemble and is quite reliable and durable in use. The elimination of bungee and spring elements to attach the central rebound element to the surrounding tubes reduces expense and injuries. Hence, many of the disadvantages of prior art water trampolines are corrected by the present invention.

Although a preferred embodiment of the invention has been disclosed for purposes of illustration, it should be understood that various changes, modifications and substitutions may be incorporated in that embodiment without departing from the spirit of the invention, which is defined by the claims which follow.

What is claimed is:

1. An inflatable water trampoline, comprising:

a generally donut-shaped inflatable tube having an open center area;

a rebound member configured to extend over the open center area of the inflatable tube, the rebound member providing a trampoline effect for a user when the rebound member is operatively secured to the tube;

wherein the tube includes a plurality of side-by-side loop elements extending inwardly toward the center area thereof from an upper surface of the tube around the periphery thereof, and wherein the rebound member includes a plurality of side-by-side loop elements which extend outwardly from the periphery of the rebound member, wherein the loop elements from the tube and the loop elements from the rebound member extend toward each other and terminate endwise closely adjacent to each other, wherein the loop elements from the tube and the loop elements from the rebound member are not directly connected and are structured to permit a cord member to be weaved through; and a first cord member extending through loop elements on the rebound member and the tube, and arranged so as to securely connect the rebound member and the tube.

2. An article of claim 1, wherein the loop elements of the tube are immediately side adjacent and the loop elements of the rebound member are also immediately side adjacent, wherein the first cord member extends alternately through alternate loop elements of the tube and the rebound member, and wherein the trampoline includes a second cord member which extends those alternate loop elements through which the first cord member does not extend, and wherein the first and second cord members are tightened and secured so that loop elements from the tube come adjacent endwise with loop elements from the rebound member.

3. An article of claim 1, wherein the loop elements from the tube and the rebound member are substantially identical in length and width, and arranged so that the plurality of loop elements from the tube are substantially in registry, endwise, with loop elements from the rebound member.

4. An article of claim 2, wherein the first and second cord members are nylon, approximately ¼ inch thick.

5. An article of claim 1, wherein the tube is made from PVC material.

6. An article of claim 1, including a PVC lower cover element which extends across the center area at the bottom of the tube.

7. An article of claim 1, wherein the rebound member is a nylon/PVC mesh.

8. An article of claim 1, wherein the rebound member is attached to the tube along the upper peripheral surface of the tube, slightly inwardly of the tube from top dead center thereof.

9. An inflatable water trampoline, comprising:

a generally doughnut-shaped inflatable tube having an open center area;

a rebound member configured to extend over the open center area of the inflatable tube, the rebound member providing a trampoline effect for a user when the rebound member is operatively secured to the tube;

wherein the tube includes a plurality of side-by-side loop elements extending inwardly toward the center area thereof from an upper surface of the tube around the periphery thereof, and wherein the rebound member includes a plurality of loop elements which extend outwardly from the periphery of the rebound member, wherein the loop elements from the tube and the loop elements from the rebound element are structured to permit a cord member to be weaved therethrough; and a first cord member extending through loop elements on the rebound member and the tube and arranged so as to securely connect the rebound member and the tube, wherein the loop elements of the tube are immediately side adjacent and the loop elements of the rebound member are also immediately side adjacent, wherein the first cord member extends alternately through alternate loop elements of the tube and the rebound member, and wherein the trampoline includes a second cord member which extends those alternate loop elements through which the first cord member does not extend, and wherein the first and second cord members are tightened and secured so that loop elements from the tube come adjacent endwise with loop elements from the rebound member.

* * * * *